US005827639A

United States Patent [19]

Saitou

[11] Patent Number: 5,827,639

[45] Date of Patent: Oct. 27, 1998

[54] SILVER HALIDE EMULSION

[75] Inventor: Mitsuo Saitou, Kanagawa, Japan

[73] Assignee: Fuji Photo Film Co., Ltd., Kanagawa, Japan

[21] Appl. No.: 931,836

[22] Filed: Sep. 17, 1997

Related U.S. Application Data

[63] Continuation of Ser. No. 676,916, Jul. 8, 1996, abandoned, which is a continuation of Ser. No. 506,573, Jul. 25, 1995, abandoned, which is a continuation of Ser. No. 268,739, Jun. 30, 1994, abandoned, which is a continuation of Ser. No. 59,277, May 11, 1993, abandoned.

[30] Foreign Application Priority Data

May 12, 1992 [JP] Japan ..... 4-145031

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,063,951 | 12/1977 | Bogg | 430/567 |
| 4,386,156 | 5/1983 | Mignot | 430/567 |
| 4,946,772 | 8/1990 | Ogawa | 430/567 |
| 5,264,337 | 11/1993 | Maskasky | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,558,982 | 9/1996 | Maskasky et al. | 430/567 |

OTHER PUBLICATIONS

James, T. H. ed., The Theory of the Photographic Process, Macmillan Publishing Co, Inc., 1977, p. 89.

*Primary Examiner*—Mark F. Huff

*Attorney, Agent, or Firm*—Sughrue, Mion, Zinn, Macpeak & Seas, PLLC

[57] ABSTRACT

A novel silver halide emulsion containing a dispersing agent and silver halide grains is provided, characterized in that first tabular grains having a (100) plane as a main plane and an aspect ratio (diameter/thickness) of 1.5 or more whose shape on the main plane is a rectangular parallelogram having one to four corners non-equivalently missing account for 10% or more of all silver halide grains calculated in terms of projected area. In a preferred embodiment, 20% or more of the grains other than said first tabular grains calculated in terms of projected area is occupied by second tabular grains having a (100) plane as a main plane, an aspect ratio of 1.5 or more and the shape on the main plane of substantially a rectangular parallelogram.

17 Claims, 4 Drawing Sheets

SILVER HALIDE EMULSION

This is a continuation of application Ser. No. 08/676,916, filed Jul. 8, 1996 (abandoned), which is a continuation of application Ser. No. 08/506,573, filed Jul. 25, 1995 (abandoned), which is a continuation of application Ser. No. 08/268,739, filed Jun. 30, 1994 (abandoned), which is a continuation of application Ser. No. 08/059,277, filed May 11, 1993 (abandoned).

FIELD OF THE INVENTION

The present invention relates to a silver halide (hereinafter referred to as. "AgX") useful in the field of photography. More particularly, the present invention relates to an AgX emulsion containing AgX grains having a novel shape.

BACKGROUND OF THE INVENTION

Photographic light-sensitive materials comprising tabular AgX emulsion grains exhibit improved color sensitization, sharpness, light-scattering properties, covering power, progress of development, graininess, etc. as compared with those comprising nontabular AgX emulsion grains. Therefore, tabular grains having parallel twinning planes and a (111) plane as a main plane are now used more often than ever. For details, reference can be made to JP-A-58-113926, JP-A-58-113927, JP-A-58-113928, JP-A-2-838, JP-A-2-28638, and JP-A-2-298935 (The term "JP-A" as used herein means an "unexamined published Japanese patent application"). However, if a large amount of a sensitizing dye is adsorbed onto AgX grains, grains having a (100) plane normally exhibit enhanced color sensitization as compared to other grains. Accordingly, the development of tabular grains having a (100) plane as a main plane has been desired. Such grains whose shape on the main plane is a rectangular parallelogram are described in U.S. Pat. Nos. 4,063,951, and 4,386,156. However, all these references relate to rectangular parallelepiped grains whose shape on the main plane is a rectangular parallelogram and whose faces are all on (100) planes. As compared with such grains whose faces are all on (100) planes, grains having other crystal faces as well are preferably used to provide grain faces having different functions. Furthermore, the relative number of such other crystal faces is preferably limited. For a description of separation of the various functions among grain faces, reference can be made to JP-A-2-34, JP-A-1-201651, and JP-A-2-298935.

SUMMARY OF THE INVENTION

It is therefore an object of the present invention to provide tabular AgX emulsion grains having a (100) plane as a main plane and other crystal faces on the edge of such grains.

It is another object of the present invention to provide an AgX emulsion comprising AgX grains which can prevent latent image dispersion to a greater extent, and which provides high image quality with high sensitivity and graininess.

These and other objects of the present invention will become more apparent from the following detailed description and Examples.

The objects of the present invention are accomplished with a silver halide emulsion comprising a dispersing agent and silver halide grains, wherein first tabular grains having a (100) plane as a main plane and an aspect ratio (diameter/thickness) of 1.5 or more whose shape on the main plane is a rectangular parallelogram having one to four corners non-equivalently missing account for 10% or more of all silver halide grains calculated in terms of projected area.

The objects of the present invention are also accomplished with a silver halide emulsion as defined above, wherein 20% or more of the grains other than said first grains calculated in terms of projected area is occupied by second tabular grains having a (100) plane as a main plane, an aspect ratio of 1.5 or more and the shape on the main plane of substantially a rectangular parallelogram.

BRIEF DESCRIPTION OF THE DRAWINGS

By way of example and to complement the following description, reference is made to the accompanying drawings in which.

DETAILED DESCRIPTION OF THE INVENTION

The structure of the AgX grains according to the present invention are first described in detail below. The description of the process for preparation of the grains follows. The term "projected area" as used herein means "projected area of AgX emulsion grains which are not superimposed upon each other and, if they are tabular grains, are disposed on a substrate with its main plane parallel thereto".

A. Structure of AgX grain

Figure 1A:
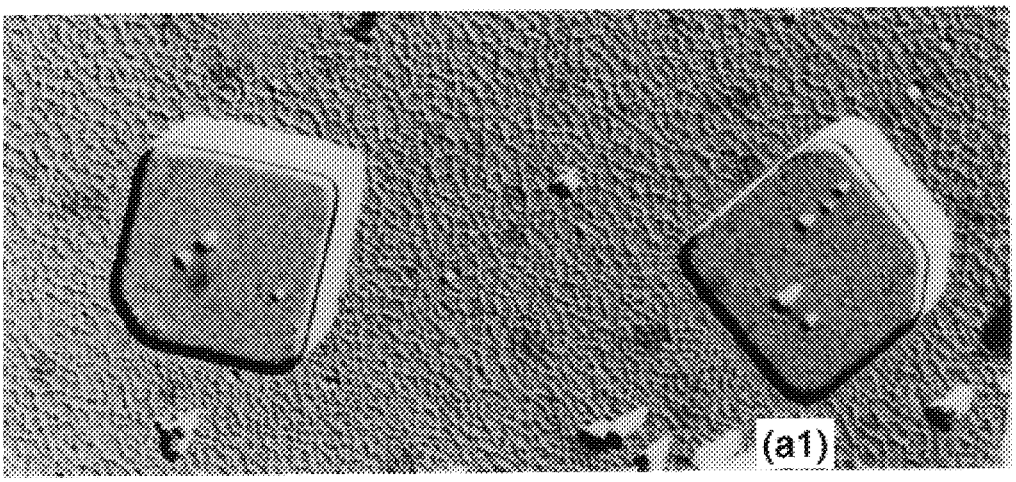
FIGS. 1A and 1B are photographs of AgX grains illustrating examples of the crystalline structure of tabular grain 1 of the present invention (x 20,000). One of the two grains in FIG. 1A is identified as Grain (a1). One of the three grains in FIG. 1B is identified as Grain (a3).
Figure 1B:
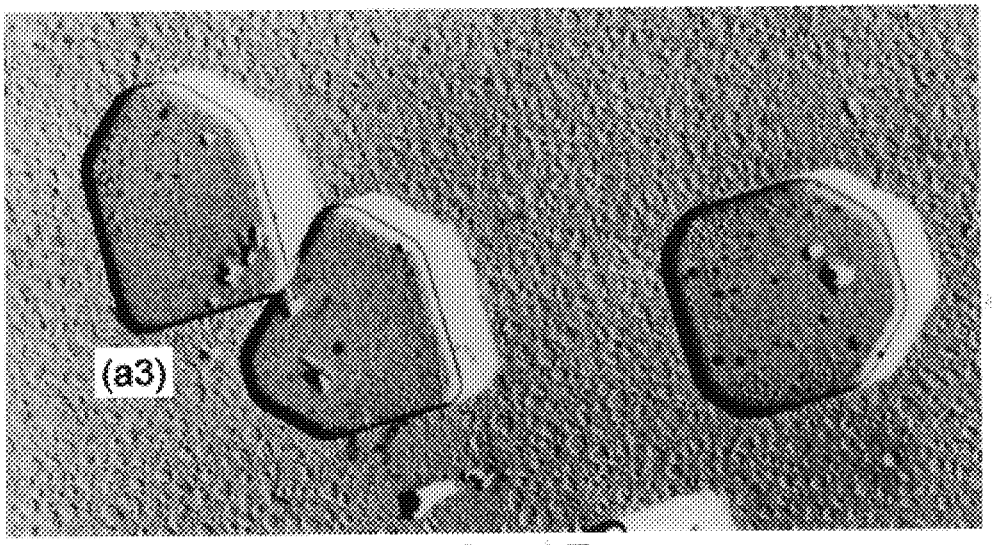

The shape of the main plane of the tabular AgX grains of the present invention is exemplified in FIGS. 1A and 1B. Specifically, the shape of the main plane is a rectangular parallelogram having one to four corners non-equivalently missing (i.e., four corners are not equivalent). The term "non-equivalently missing" as used herein means that x (=(area of maximum missing portion/area of minimum missing portion)) is 2 or more, preferably 4 or more, more preferably 6 to $\infty$.

The shape of tabular grains 1 is specifically shown in FIGS. 1 and 4 and the number of missing portions in one tabular grain 1 which satisfies the relationship $X \leqq 2$ is 1 to 3, preferably 1 to 2, more preferably 1.

The length of a side of the minimum missing portion in tabular grains 1 is preferably 20% or less, more preferably 10% or less, of the respective side of the rectangular parallelogram formed by extending the side of the original grain form.

If there is no elimination in one of the corners (i.e., minimum missing portion), x is $\infty$.

Figure 1C:
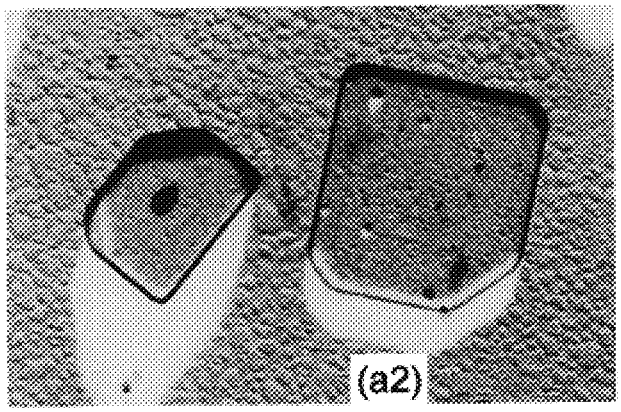
FIG. 1C illustrates a low aspect ratio grain having (111) planes as a result of asymmetrical elimination of the left corner of the grain (x 20,000). One of the two grains in FIG. 1C is identified as Grain (a2).

The main plane is the (100) plane. On the other hand, the edge face of the missing portion is considered to be a (111)

plane. This is because grains having a shape as shown in FIG. 1C are observed. In FIG. 1C, two corners of a thick rectangular parallelepiped grain are missing in the form of trigonal pyramid. In this case, the face of the missing portion is crystallographically the (111) plane. The term "main plane" as used herein means a "plane face having the maximum surface area among the external faces of a tabular grain". The edge face of the non-missing portion is generally considered to be the (100) plane. This is based on the fact that observation of a replica of the grain under a transmission electron microscope (TEM image) shows that the edge face is at right angles to the main plane. The length of a side of the maximum missing portion is preferably from 10 to 50%, more preferably from 15 to 40% of the length of the respective side of the rectangular parallelogram formed by extending the side of the original grain form.

The aspect ratio of the tabular grain is 1.5 or more, preferably 2 or more, more preferably 4 to 20. The term "aspect ratio" as used herein means the ratio of diameter/thickness of the tabular grain, the diameter being the diameter of a circle having the same area as the projected area of the grain determined under an electron microscope, and the thickness being the distance between the main planes of the tabular grain.

Such a tabular grain will be hereinafter referred to as "tabular grain 1".

In the AgX emulsion according to the present invention, such tabular grains account for 10% or more, preferably 30 to 100%, more preferably 60 to 100% of the total projected area of all AgX grains in the emulsion.

Furthermore, 20% or more, preferably 50 to 100%, more preferably 80 to 100%, of the total projected area of the grains other than said tabular grains 1 is occupied by second tabular grains having the (100) plane as a main plane, an aspect ratio of 1.5 ore more, preferably 2 or more, more preferably 4 to 20 and the shape on the main plane of substantially a rectangular parallelogram. The term "substantially a rectangular parallelogram" as used herein means that the aforementioned value x satisfies the relationship $x \leqq 1.7$, preferably $x \leqq 1.5$, more preferably $x \leqq 1.2$. Moreover, the length of a side of the maximum missing portion is preferably 15% or less, more preferably 10% or less of the length of the respective side of the rectangular parallelogram formed by extending the side of the original form.

Such a grain will be hereinafter referred to as "tabular grain 2".

The diameter of the tabular grains 1 and 2 calculated in terms of the diameter of a circle having the same projected area as that of the grain is 10 $\mu$m or less, preferably 0.15 to 5 $\mu$m, more preferably 0.2 to 3 $\mu$m. The grain size distribution of a mixture of tabular grains 1 and tabular grains 2 is preferably monodisperse. The coefficient of variation of grain size distribution is preferably 40% or less, more preferably 30% or less, further preferably 20% or less. The term "coefficient of variation" as used herein is the percentage obtained by dividing the distribution (standard deviation $\sigma$) of grain size represented by the diameter of a circle having the same projected area as that of the grains by the average grain size. The average halogen composition of the mixture of tabular grains 1 and tabular grains 2 are AgBr, AgClBr ($Cl^-$ content: preferably 75 mol % or less, more preferably 45 mol % or less, still more preferably 40 mol % or less), AgBrI ($I^-$ content: 30 mol % or less), and mixed crystals of two or more of these compositions. The average $I^-$ content of the grain is more preferably 10 mol % or less.

Figure 2A:
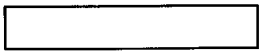
FIGS. 2A to 2G illustrate examples of the structure of the halogen composition in the grain, showing that the shadow portion and the white portion have different halogen compositions.
Figure 2B:
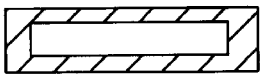
Figure 2C:
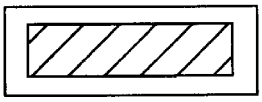

Examples of the grain structure include a uniform halogen composition type as shown in FIG. 2A, a double structure type as shown in FIG. 2B which differs in halogen composition from core to shell, and a multiple structure type as shown in FIG. 2C having a core and two or more shells. The structure types as shown in FIGS. 2B and 2C may have two embodiments. In one of the two embodiments, the $I^-$ (iodide) content in the outermost layer is lower than that in the inner layers. In the other embodiment, the $I^-$ content in the outermost layer is higher than that in the inner layers. Use of the two embodiments is appropriately selected depending on the intended purpose. For the case where the $I^-$ content in the grain surface is higher than that in the core, reference can be made to JP-A-3-148648, JPA-2-123345, JP-A-2-12142, and JP-A-1-284848. The structure type as shown in FIG. 2C may have an embodiment in which the $I^-$ content in an interlayer, for example, is higher than that in the outermost layer. For this structure, reference can be made to JP-A-60-35726, and JP-A-60-258536.

The change in halogen composition between these layers may be gradual or sudden (increasing or decreasing) depending on the intended purpose. For such changes in halogen composition, reference can be made to JP-A-63-220238, JP-A-59-45438, JP-A-61-245151, JP-A-60-143331, and JP-A-63-92942. The difference in $I^-$ content between these layers is preferably 1 mol% or more, more preferably 2 to 10 mol %. The difference in Cl(chloride) content between these layers is preferably 1 mol % or more, more preferably 5 to 50 mol %. The thickness of the outermost layer and interlayer are each preferably 3 or more lattice layers, more preferably 12 lattice layers to 0.5 $\mu$m. The thickness of the core in the innermost layer is preferably from 0.02 $\mu$m or more, preferably 0.04 $\mu$m or more, more preferably 0.06 $\mu$m to 0.6 $\mu$m. Herein, a lattice layer indicates the distance between the center of two $Ag^+$ lattice ions in $Ag^+—X^-—Ag^+$.

Figure 2D:
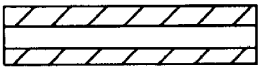
Figure 2E:
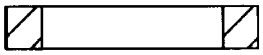
Figure 2F:
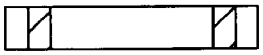
Figure 2G:
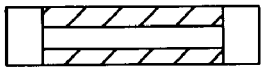

Other examples of the structure of the tabular grain include a sandwich structure type as shown in FIG. 2D in which selectively different silver halide layers are laminated only on the upper and lower main planes; the structure types as shown in FIGS. 2E and 2F in which different silver halide layers are laminated in the direction toward the edge of the tabular grain; and a structure obtained by combining two or more structure types of FIGS. 2B to 2F, e.g. , the structure type as shown in FIG. 2G.

In the grains of structure types as shown in FIGS. 2A to 2G, one grain has at least a (100) plane and a (111) plane. In this case, the difference in crystal habit between the two planes can be utilized to selectively form chemical sensitizing nuclei on the (111) plane. In this case, y (=(number of chemical sensitizing nuclei on the (111) plane/$cm^2$)/(number of chemical sensitizing nuclei on the (100) plane/$cm^2$)) is preferably 2 or more, more preferably 4 or more. It is difficult to make a direct observation of this ratio. However, this ratio of chemical sensitizing nuclei can be determined by (i) exposing an AgX emulsion-coated material (non-superimposed, single grain-coated material) to light (for a 1 second exposure at an intensity needed to provide a density of (maximum density - minimum density) x ½ when the exposed photographic light-sensitive material is developed with a developer MAA-1 (described in "Journal of Photographic Science" vol. 23, pp. 249–256, 1975) at a temperature of 20° C. for 10 minutes and at up to 10 times this intensity) to form latent images in the chemical sensitizing nuclei; (ii) subjecting the material to arrested development; and (iii) then counting the number of the arrested-developed nuclei under an electron microscope. For details of such an evaluation, reference can be made to D. C. Brich, "Journal of Photographic Science", vol. 23, pp. 249–256, 1975, and JP-A-64-62631, and JP-A-64-74540.

The thickness of tabular grains 1 and 2 are each preferably 1.0 μm or less, more preferably 0.03 to 0.6 μm, further preferably 0.04 to 0.3 μm. The thickness is preferably uniform among these tabular grains. The coefficient of variation of the thickness distribution is preferably 40% or less, more preferably 30% or less, further preferably 20% or less. The coefficient of variation is represented by [(standard deviation a of thickness distribution/average thickness) x 100%].

The edge of the missing portion of tabular grains 1 is observed to have a (111) plane in the aforementioned form. However, the (110) plane is occasionally present. This is because that the edge is occasionally observed to be perpendicular to the main plane. The ratio of the area of the (111) plane to the total area of the edge is preferably 70% or less, more preferably 5 to 50%. The ratio of the area of the (111) plane to the total surface area of tabular grain 1 is preferably 40% or less, more preferably 1 to 20%.

Figure 3:
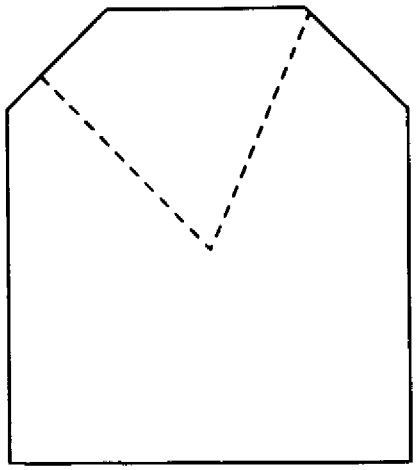
FIG. 3 illustrates an example of dislocation lines observed in tabular grain 1 of the present invention.
Figure 4A:
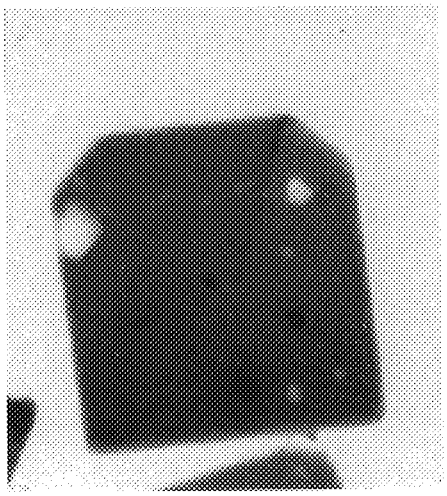
FIGS. 4A to 4C are photographs of an AgX grain illustrating an example of the crystalline structure (dislocation line) of tabular grain 1 of the present invention (x 11,000).
Figure 4B:
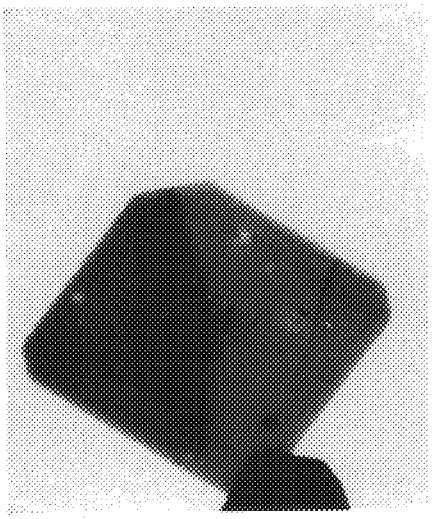
Figure 4C:
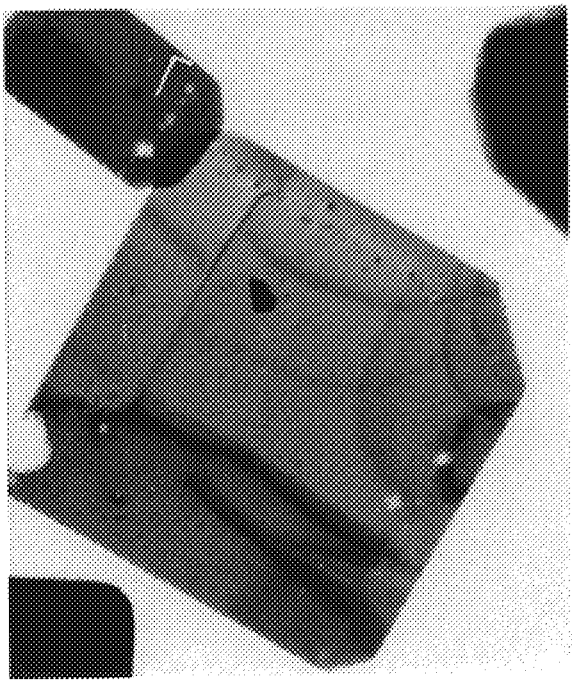

Tabular grains 1 are occasionally observed to have a dislocation line in the form as shown in FIG. 3 at a temperature as low as 77° K. under a transmission electron microscope. A photograph illustrating the dislocation line is shown in FIG. 4A. Dislocation lines in the form as shown in FIGS. 4B and 4C are occasionally observed.

Preferably 40% or more, more preferably 60% or more, further preferably 80% or more of tabular grains 1 or 2 are tabular grains having an adjacent side ratio of 1 to 2, preferably 1 to 1.5. The term "adjacent side ratio" as used herein means (maximum side length/minimum side length) in the rectangular parallelogram on one grain. In tabular grains 1, the side length indicates the length of a side of the rectangular parallelogram formed by making up for the missing portions.

The average value (%) of Z (=(the sum of the volume of the missing portions)/(the volume of the grain formed by making up for the missing portions)) is preferably 50% or less, more preferably 3 to 30%.

The aforementioned grains 1 and 2 are tabular grains. This is because the edge grows in preference to the main planes. The reason for this phenomenon is possibly an intragrain defect (e.g., screw dislocation that gives a growth vector in the direction toward the edges. For this mechanism, reference can be made to A. Mignot, "Journal of Crystal Growth", vol. 23, pp. 207–213 (1974).

In the following preparation method comprising a nucleation step and a ripening step, when tabular grains are formed under the same ripening conditions but different nucleation conditions, the probability of formation of tabular grains varies. Accordingly, the aforementioned defect is considered to be formed during nucleation.

B. Preparation of AgX emulsion according to the present invention

The AgX emulsion of the present invention can be prepared via at least a nucleation step followed by a ripening step.

The description will begin with the nucleation step.

1) nucleation step

To a dispersing agent solution containing at least a dispersing agent and water were added a solution of $AgNO_3$ and a solution of a halide salt (hereinafter referred to as "$X^-$ salt") by a double jet process to form AgX nuclei. The $Br^-$ concentration during the nucleation step is preferably $10^{-2.3}$ mol/l or less, more preferably $10^{-2.6}$ mol/l or less, further preferably $10^{-3}$ mol/l or less. The $Ag^+$ concentration is preferably $10^{-4}$ mol/l or more, more preferably $10^{-3.7}$ to $10^{-1.5}$ mol/l or less, further preferably $10^{-3.4}$ to $10^{-1.5}$ mol/l or less. The $X^-$ salt may be an alkaline metal salt or an ammonium salt. The $Ag^+$ salt may be $AgNO_3$. Known photographic dispersing agents can be used. In general, gelatin is preferably used, more preferably alkali-treated bone gelatin. Bones as starting materials are not specifically limited. In general, weather-beaten bones of Indian-grown cattle or bones of freshly-butchered cattle can be used. The gelatin may be deionized through an anion exchange resin or cation exchange resin before use. The calcium content of the gelatin is not particularly limited, and is generally between 0 and $10^4$ ppm depending on the intended purpose.

For details of gelatin, reference can be made to the literature citations below. The concentration of dispersing agent in the reaction vessel is preferably in the range of 0.1% by weight or more, more preferably 0.2 to 10% by weight, further preferably 0.3 to 5% by weight. Furthermore, gelatin may be contained in a solution of the $Ag^+$ salt and/or a solution of the $X^-$ salt. In this case, the gelatin concentration is preferably in the range of 0.1 to 5% by weight, more preferably 0.2 to 3% by weight, and is particularly preferably about the same as the gelatin concentration in the reaction vessel. "About the same as the gelatin concentration in the reaction vessel" means that (concentration difference/gelatin concentration in the reaction vessel) is preferably in the range of 50% or less, more preferably 25% or less. When a solution of the $Ag^+$ salt and a solution of the $X^-$ salt are added to the solution in the reaction vessel from an addition port below the liquid level, non-uniformity in the gelatin concentration in the vicinity of the addition port is eliminated, enabling uniform nucleation.

The temperature at which nuclei are formed is not limited, and is preferably 10° C. or higher, preferably from 20° C. to 75° C. After nucleation, the material is then subjected to physical ripening to eliminate nontabular grains and to allow the tabular grains to grow. However, if the nucleating temperature is elevated, nucleation can be accompanied by ripening. The rate at which $AgNO_3$ salt is added is preferably 2 to 30 g/min., more preferably 4 to 20 g/min. per 1 of solution in the vessel. The period during which nuclei are formed is preferably 10 minutes or less, more preferably 10 seconds to 5 minutes, further preferably 10 seconds to 3 minutes. The pH value of the solution in the vessel is not particularly limited, and is generally in the range of 2 to 11, preferably 3 to 11. The most suitable pH value can be selected depending on processing parameters such as excess $Ag^+$ concentration, temperature and the like.

The value of w (=number of defects/number of grains) developed during nucleation depends on the nucleating conditions. In the case of formation of AgBr nuclei, the value of w reaches a maximum when the pH value of the solution in the vessel is in the range of 7 to 8, and decreases as the pH value of the solution in the vessel increases or decreases from this range. The value of w reaches a maximum when the concentration of excess $Ag^+$ ion is in the vicinity of $10^{-2.7}$ mol/l, and decrease as the concentration of excess $Ag^+$ ion increases or decreases from this range. The value of w increases as the gelatin concentration in the solution in the vessel decreases. However, when the gelatin concentration in the solution in the vessel is in the range of 0.2% by weight or less, various defects occur, causing a rise in the proportion of nontabular defective grains. The value of w increases as the rate at which the $Ag^+$ salt and $X^-$ salt solution increases. However, when the rate at which the $Ag^+$ salt and $X^-$ salt solution are added is too high, the proportion of nontabular defective grains increases. As the nucleation period decreases with the $Ag^+$ salt and $X^-$ salt solution addition rate kept constant, the value of w decreases. The value of w decreases as the temperature increases.

These phenomena are observed with variation of only one condition, with the other conditions kept constant. In other words, an emulsion which has been subjected to nucleation under various conditions is ripened at an elevated temperature of 75° C. with other conditions kept constant (pH 6.5; $Ag^+$ concentration≐$Br^-$ concentration; gelatin concentration=2% by weight). The emulsion is then sampled with ripening time. The value of w is a result of the comparison of the average volume of tabular grains determined from a photograph of the emulsion in which nearly all nontabular grains have been eliminated (photograph of a replica of grains taken under a scanning electron microscope). Alternatively, the emulsion may be sampled at the initial time of ripening (e.g., shortly after temperature rising). The value of w can be determined by calculating the proportion of tabular grains from a photograph of grains thus sampled. These factors have a mutual additive effect. When the value of w is too low, the probability of formation of tabular grains is low. Accordingly, these nucleating conditions are properly adjusted so that the value of w is not too low or high, so that the proportion of projected area of the tabular grains in the resulting emulsion is in the above specified range.

Furthermore, the value of w is preferably optimized in a range remote from the range of the equivalent concentration point of $Ag^+$ and $Br^-$. Specifically, nucleation may be effected when the excess $Ag^+$ concentration is preferably in the range of $10^{-3.4}$ mol/l or more, more preferably $10^{-3.0}$ to $10^{-1.5}$ mol/l. This advantageously minimizes the effect of addition rate accuracy of the $AgNO_3$ solution and the $Br^-$ salt solution. If nucleation is effected in this range, the value of w is generally too high. However, the aforementioned factors may be controlled to lower the value of w to an optimum value. Alternatively, when the excess $Ag^+$ concentration increases to some range, the value of w decreases. In this range, the excess $Ag^+$ concentration may be adjusted to adjust the value of w to the desired value. For other relevant details, reference can be made to Japanese Patent Application No. 4-77261.

In order to form the aforementioned defects under controlled conditions with good reproducibility during nucleation, a halogen composition gap interface (difference) is preferably formed. Specific examples of such an approach include a method which comprises forming AgCl nuclei, and then adding an $AgNO_3$ solution and KBr solution to the material to form (core(AgCl)/shell(AgBr)) nuclei, and a method which comprises forming AgBr nuclei, adding an $AgNO_3$ solution and NaCl solution to the material, and then adding an $AgNO_3$ solution and KBr solution to the material to form multilayer nuclei (AgBr/AgCl/AgBr). Similarly, (AgBr/AgBrI/AgBr) nuclei, (AgBr/AgI/AgBr) nuclei, or (AgBr/AgSCN/AgBr) nuclei may be formed. For example, a method which comprises forming one or more gap interfaces of $Cl^-$ content, a $Br^-$ content, a $I^-$ content and a $SCN^-$ content in nuclei during nucleation (to thereby strain lattices and hence control the frequency of defect formation) is particularly effective. The difference in $Cl^-$ content between AgBrCl phases is preferably in the range of 10 to 100 mol %, more preferably 50 to 100 mol %, further preferably 80 to 100 mol %. The difference in $I^-$ content between AgBrI phases is preferably in the range of 10 to 100 mol %, more preferably 50 to 100 mol %. The grain diameter of the nucleus is preferably in the range of 0.02 to 0.15 μm, more preferably 0.03 to 0.1 μm, calculated in terms of a circle having the same projected area as that of the nucleus. The temperature at which the nucleus is formed is preferably in the range of 25° C. or higher, more preferably 35° C. to 60° C. The gelatin concentration is preferably in the range of 0.5% by weight or more, more preferably 1 to 7% by weight. The pH value, excess silver ion concentration, etc. are as specified above. In this case, the aforementioned halogen composition gap exists in the central portion of the grain shown in FIGS. 2B to 2G. The term "central portion" as used herein means the aforementioned (core/shell) nucleus or multi-layer nucleus site.

2) Ripening step

It is difficult to form only tabular grain nuclei during nucleation. Accordingly, grains other than tabular grains are eliminated by Ostwald ripening at a subsequent ripening step. The ripening temperature is preferably 10° C. or more higher, more preferably 20° C. or more higher than the nucleating temperature. In general, the ripening temperature is in the range of 50° C. to 90° C., preferably 60° C. to 80° C. If the ripening temperature is 90° C. or higher, ripening is preferably effected under atmospheric pressure or higher pressure, more preferably 1.2 times or more the atmospheric pressure. For details of ripening under pressures higher than atmospheric pressure, reference can be made to Japanese Patent Application No. 3-343180.

The excess $Ag^+$ and $Br^-$ ion concentration in the solution being ripened is preferably in the range of $10^{-2.3}$ mol/l or less, more preferably $10^{-2.6}$ mol/l or less. The pH value of the solution is preferably in the range of 2 or more, more preferably 2 to 11, further preferably 2 to 7. When the solution is ripened under these pH and pAg conditions, nondefective cubic finely divided grains are mainly eliminated, and tabular grains preferentially grow in the direction toward the edge. As the ripening conditions further depart from this excess ion concentration condition, the preference for growth of the edge is lowered, thereby reducing the rate at which nontabular grains are eliminated. Furthermore, the proportion of growth of the main planes of the grain is increased, thereby reducing the aspect ratio of grain. If an AgX solvent is present during the ripening, the ripening is accelerated. However, since this condition varies with halogen composition of the AgX grains, pH, pAg, gelatin concentration, temperature, AgX solvent concentration, etc., the optimum conditions can be readily selected by systematically varying the respective processing conditions. In general, almost 100% of tabular grains thus ripened are in the form of tabular grains 2. The growth of the tabular grains is completed at a subsequent crystallization step, to thereby obtain grains having a shape according to the present invention.

On the other hand, excess $Br^-$ concentration in the solution can be properly controlled after the ripening, or shortly before the completion of the ripening, to thereby obtain AgX grains according to the present invention. In other words, by properly selecting the excess $Br^-$ concentration and the ripening time, tabular grains 1 with different x values can be formed. The $Br^-$ concentration is preferably in the range of $10^{-2.3}$ mol/l or less, more preferably $10^{-4}$ to $10^{-2.6}$ mol/l. The ripening time is generally in the range of 3 minutes or more, preferably 10 to 60 minutes. However, when the system is subjected to only this nucleation step followed by ripening, the amount of AgX grains (mol/l) thus prepared is too small to be of practical value, and the grain size cannot be freely selected. Therefore, the following crystallization step is normally effected.

3) Crystallization step

When crystallization occurs in the vicinity of the equivalent concentration point of the excess $Ag^+$ and $Br^-$ ion concentration of $10^{2.3}$ mol/l or less, more preferably $10^{-2.6}$ mol/l or less, the grain preferentially grows in a direction towards the edge. In particular, when the excess $Ag^+$ and $Br^-$ ion concentration is in the range of $10^{-3}$ mol/l or less, grains in the form of tabular grain 2 having a high aspect ratio can be obtained. As the $Ag^+$ ion concentration increasingly departs from the vicinity of equivalent concentration point, or as the supersaturation degree during crystallization increases, the proportion of growth in the direction of the main planes to that of growth in the direction towards the edge increases. As the $Ag^+$ ion concentration is increased from the equivalent concentration point, and, in particular, when the $Ag^+$ ion concentration is more than $10^{-2.6}$ mol/l, the shape of the main plane is a rectangular parallelogram and the proportion of growth in thickness to that in the direction of the main plane increases. As the $Br^-$ ion concentration increases from the equivalent concentration point, the corners of the rectangular parallelogram are non-equivalently eliminated when the excess $Br^-$ concentration is in the range of $10^{-4}$ to $10^{-2.3}$ mol/. When the pBr value of the system during crystallization is in the range for growth of octahedral grains (e.g., 2 or less in the case of AgBr), all the four corners of the tabular grain are eliminated and the edge face is changed to a (111) plane. The grain then grows in thickness, and eventually becomes an octahedral grain.

These conditions change with the halogen composition of the grain, pH of the solution, temperature, AgX solvent concentration, etc. Accordingly, the desired AgX grains are preferably prepared after first confirming that the desired grains are obtained under the specific growth conditions under consideration. This is done, e.g., by allowing grains to grow under various $X^-$ salt concentrations. Examples of methods for obtaining the grains of the present invention include a method which comprises selecting conditions under which the grains of the present invention can be obtained by appropriate selection of crystallization conditions, and a method which comprises allowing the grains to be crystallized under conditions for the formation of tabular grains 2, and then ripening the grains. The ripening conditions are as specified above. The $Br^-$ ion concentration is preferably in the range of $10^{-2.3}$ mol/l or less, more preferably $10^{-4}$ to $10^{-2.6}$ mol/l. The temperature at which crystallization occurs is generally in the range of 40° C. or higher, more preferably 50° to 90° C. As the method for adding solutes to the system during crystallization, the following two methods are effectively used.

(1) Fine emulsion addition process

An emulsion of finely divided AgX grains having a diameter of 0.15 μm or less, preferably 0.1 μm or less, more preferably 0.06 to 0.006 μm may be added to the system which is then subjected to Ostwald ripening to allow the tabular grains to grow. The fine emulsion may be continuously or intermittently added to the system. The fine emulsion may be continuously prepared by supplying an $AgNO_3$ solution and an $X^-$ salt solution into a mixer provided in the vicinity of the reaction vessel, and then by immediately adding the contents of the mixer to the reaction vessel in a continuous manner. Alternatively, the fine emulsion may be batchwise prepared before hand in a second vessel, and then continuously or intermittently added to the system. The fine emulsion may be added to the system in the form of a liquid or dried powder. The finely divided grains are substantially free of multi-twin grains. The term "multi-twin grain" as used herein means a "grain having two or more twinning planes". "Substantially free of multi-twin grains" means that the number proportion of multi-twin grains in an emulsion is in the range of 5% or less, preferably 1% or less, more preferably 0.1% or less. Furthermore, the finely divided grains are also substantially free of single-twin grains. Moreover, the finely divided grains are substantially free of screw dislocations. "Substantially free of screw dislocations" is as specified above with respect to multi-twin grain content.

The halogen composition of the finely divided grains can be AgCl, AgBr, AgBrI ($I^-$ content is preferably 20 mol % or less, more preferably 10 mol % or less), and mixed crystals of two or more kinds selected therefrom.

The solution conditions under which the grains grow are the same as the aforementioned ripening conditions. This is because the two steps employ the same reaction mechanism, i.e., the step in which tabular grains are grown and other grains are eliminated in Ostwald ripening. This fine emulsion addition process is preferably used as a method for allowing the tabular grains to grow selectively in a direction towards the edge. For details of the fine emulsion addition process, reference can be made to Japanese Patent Application Nos. 2-142635, and 4-77261, and JP-A-1-183417.

(2) Ion solution addition process

In this method, an $Ag^+$ salt solution and an $X^-$ salt solution are simultaneously added to the system at an addition rate which substantially does not form new nuclei, to thereby allow the tabular grains to grow. The expression "substantially does not form new nuclei" means that the proportion of projected area of new nuclei thus produced is preferably in the range of 10% or less, more preferably 1% or less, further preferably 0.1% or less. By properly selecting the pAg value, pH value, temperature, supersaturated concentration, etc. during the formation of the grains, the desired proportion of thickness-wise and edge-wise growth of the tabular grains can be obtained. In general, as the conditions increasingly depart from the aforementioned equivalent concentration point, or as the concentration of AgX solvent which is present therein increases, the proportion of growth in thickness to that of the edge of the tabular grains increases. On the other hand, when the grain growth occurs at low supersaturation in the vicinity of the aforementioned equivalent concentration point, the grains preferentially grow edgewise. The term "low supersaturation" as used herein means that these salt solutions are added to the system at a rate of 70% or less, preferably 5 to 50% of the critical addition rate. The critical addition rate is the addition rate of solutes above which the formation of new nuclei begins.

In order to control the supersaturation during grain growth, the addition rate of $Ag^+$ salt and $X^-$ salt can be increased with respect to the addition time.

Besides these addition processes, a method can be used which comprises conducting these addition processes in combination. For details of these addition processes, reference can be made to JP-A-2-146033, JP-A-3-21339, and JP-A-3-246534, and Japanese Patent Application Nos. 2-326222, and 3-36582.

In the present invention, an AgX solvent can be present in the system during nucleation, ripening and crystallization. Examples of such an AgX solvent include fog inhibitors such as ammonia, thioethers, thioureas, thiocyanates, organic amine compounds, and tetrazaindene compounds. For details, reference can be made to the literature citations below. The amount of such an AgX solvent present in the system is in the range of 0 to 0.3 mol/l.

Other examples of processes for the formation of finely divided AgX grains include a splash process. This process comprises adding a silver salt solution and a halogen salt solution to the system at a rate higher than the critical addition rate (addition rate above which new nuclei are produced) for a short period of time to form many new nuclei. The addition rate is preferably 1.1 times or more, more preferably 1.2 to 20 times, further preferably 1.3 to 10 times the critical addition rate. The addition time is preferably 5 minutes or less, more preferably 1 second to 2 minutes, further preferably 1 second to 1 minute. The finely divided grains thus formed preferably conform to the aforementioned specification.

In general, the supersaturation necessary for growth of a perfect crystal face is greater than that necessary for the growth of faces having screw dislocations and parallel twinning planes. The fine grain addition and growth processes enable selective growth of faces having the aforementioned defects without causing the perfect crystal face to grow. This is achieved by properly adjusting the size of the finely divided grains. Accordingly, the fine grain addition and growth processes are advantageously used in the present invention.

C. Process for the preparation of grains having the structures shown in FIGS. 2A to 2G The grains having the structure as shown in FIG. 2A can be formed by adding solutes having the same halogen composition to the system starting from nucleation and ending with grain growth. The grains having the structure as shown in FIG. 2B can be obtained by forming grains having the structure as shown in FIG. 2A, and then adding solutes having halogen compositions different from the host grains to the system. This allows the grains to grow both edgewise and in the direction towards the main planes.

The grains having the structure as shown in FIG. 2C can be obtained by forming grains having the structure as shown in FIG. 2B, and then adding solutes having different halogen compositions to the system. This allows the grains to grow both edgewise and in the direction towards the main planes.

The grains having the structures as shown in FIGS. 2D to 2G can be prepared by utilizing the selective growth of grains edgewise and in the direction toward main planes under properly selected grain growth conditions.

D. Other Grain Growth Considerations

Since the tabular grains of the present invention are prepared under conditions which tend to result in the preparation of fogged nuclei, the resulting emulsion may have a high fog density. In general, the higher the temperature, or the higher the pH value, or the higher the $Ag^+$ ion concentration, the higher the fog density. Fogging which occurs at the aforementioned grain formation step can be eliminated by oxidizing the silver nuclei after each step, or after completion of all the steps for grain formation.. In this oxidizing treatment, the oxidation potential of the system may be higher than that of the silver nuclei. Specifically, ripening may be effected at a pH value as low as 5 or less, preferably 1.5 to 4. Alternatively, an oxidizer may be added to the system which is then ripened and washed with water. Examples of such an oxidizer include $H_2O_2$, oxygen acids, peroxides, metallic oxides, and nonmetallic oxides. The oxidation potential of the silver nuclei depends on the size of the silver nuclei.

If a platinum electrode is used as an indicator electrode, the oxidation is preferably effected at a potential of −130 mV or higher (vs.S.C.E.), preferably −100 to +1,000 mV (vs.S.C.E.) at a temperature of 25° C. The ripening temperature is preferably 25° C. or higher, more preferably 35° C. to 80° C. Specimens with systematically varied parameters such as oxidation potential of the solution, ripening temperature and ripening time can be prepared so that the most suitable oxidation conditions are selected. For details of oxidizers and the oxidation reaction, reference can be made to "Kagaku Daijiten", description of "Oxidizing Agents", 1960, A. J. Bard et al., "Standard Potential in Aqueous Solution", Marcel Dekker, 1985, Kazuo Yamazaki, "Chemistry of Inorganic Solution", Nankodo, 1968, "Denki Kagaku Binran (Handbook of Electrochemistry", 4th ed., Maruzen, 1985, and European Patents 0435270A1, and 0435355A1.

For a description of A to C above, reference can also be made to the following.

Epitaxial grains may be formed with the thus obtained grains defined in claim 1 as host grains. Alternatively, grains with the thus obtained grains as cores having dislocations lines contained therein may be formed. Furthermore, with the thus obtained grains as substrates, AgX layers having a halogen composition different from that of the substrates may be laminated thereon to form grains having various known structures. For details, reference can be made to the literature citations below. The emulsion grains thus obtained are normally provided with chemical sensitizing nuclei.

In this case, the production site and number (per $cm^2$) of the chemical sensitizing nuclei are preferably controlled. For details, reference can be made to JP-A-2-838, JP-A-2-146033, JP-A-1-201651, JP-A-3-121445, JP-A-64-74540, JP-A-4-308840 and JP-A-4-343348 and Japanese Patent Application No. 3-140712.

In the case of tabular grains 1 of the present invention, chemical sensitizing nuclei are preferably allowed to grow preferentially on the (111) edge planes. Since the tabular grains each have (111) planes and (100) planes, a chemical sensitizer which reacts preferentially on the (111) planes may be used, or an adsorbent which preferentially adsorbs to the (100) planes may be adsorbed to the (100) planes, and a chemical sensitizer may then be added to the system for chemical sensitization. For details, reference can be made to the above cited patents.

Furthermore, with the tabular grains as cores, a shallow latent image type emulsion may be formed. Alternatively, a core/shell type grain may be formed. For details, reference can be made to JP-A-59-133542, and JP-A-63-151618, and U.S. Pat. Nos. 3,206,313, 3,317,322, 3,761,276, 4,269,927, and 3,367,778.

The AgX emulsion grains prepared according to the process of the present invention may be blended with one or more other kinds of AgX emulsions. The optimum blend proportion may be appropriately selected between 0.01 and 1.0 moles of the emulsion of the invention per mole of a different AgX emulsion.

The most suitable pH value of the reaction solution at the aforementioned steps B and C is generally selected between 1 and 12, preferably between 2 and 11. The additives which can be added to these emulsions between the formation and coating of the grains are not specifically limited. Known photographic additives can be used. Examples of such known photographic additives include AgX solvents, AgX grain doping agents (e.g., compounds of the group VIII metals, other metallic compounds, chalcogen compounds, SCN compounds), dispersing agents, fog inhibitors, sensitizing dyes (e.g., blue-sensitizing dye, green-sensitizing dye, red-sensitizing dye, infrared-sensitizing dye, panchromatic-sensitizing dye, orthochromatic-sensitizing dye), super-sensitizers, chemical sensitizers (e.g., sulfur compounds, selenium compounds, tellurium compounds, gold compounds, compound of the- group VIII noble metals, phosphur compounds, thiocyanates, reduction sensitizers, singly or in combination), fogging agents, emulsion precipitating agents, surface active agents, film hardeners, dyestuffs, dye image forming agents, color photographic additives, soluble silver salts, latent image- stabilizers, developers (e.g., hydroquinone compounds), pressure desensitization inhibitors, and matting agents.

The AgX emulsion grains of the present invention and AgX emulsions prepared according to the process of the present invention are readily used in known photographic light-sensitive materials. Examples of these photographic light-sensitive materials include black-and-white silver halide photographic materials (e.g., X-ray photographic light-sensitive materials, printing photographic light-sensitive materials, photographic paper, negative film, microfilm, direct positive photographic materials, super-finely divided grain dry plate photographic materials (for use in LSI photomask, shadow mask, liquid crystal mask)), and color photographic light-sensitive materials (e.g., negative film, photographic paper, reversal film, direct positive color photographic material, silver dye bleach process photographic materials). Further examples of such photographic light-sensitive materials include diffusion transfer type photographic light-sensitive materials (e.g., color diffusion transfer element, silver salt diffusion transfer element), heat-developable photographic light-sensitive materials (black-and-white, color), high density digital recording photographic materials, and holographic light-sensitive materials.

The optimum coated amount of silver is in the range of 0.01 $g/m^2$ or more, preferably up to 10 $g/m^2$. The configuration of the photographic light-sensitive material (e.g., layer configuration, silver/coloring material molar ratio, silver amount ratio between layers), exposure, apparatus for development and preparation of photographic light-sensitive material, emulsion dispersion of photographic emulsions, etc., are not particularly limited. Known embodiments and techniques can be used. For details of known photographic additives, photographic light-sensitive materials, their configuration, exposure and development, and apparatus for the preparation of photographic light-sensitive materials, reference can be made to the following literature citations.

Research Disclosure, vol. 176 (Item 17643), December 1978, vol. 307 (Item 307105), November 1989, Duffin, "Photographic Emulsion Chemistry", Focal Press, New York, 1966, E. J. Birr, "Stabilization of Photographic Silver Halide Emulsions", Focal Press, London, 1974, T. H. James, "The Theory of Photographic Process", 4th ed., Macmillan, New York, 1977, P. Glafkides, "Chimie et Physique Photographiques", 5th ed., Edition de I', Usine Nouvelle, Paris, 1987, 2nd ed., Paul Montel, Paris, 1957, V. L. Zelikman et al., "Making and Coating Photographic Emulsion", Focal Press, 1964, K. R. Hollister, "Journal of Imaging Science", vol. 31, pp. 148–156, 1987, J. E. Maskasky, vol. 30, pp. 247–254, 1986, vol. 32, pp. 160–177, 1988, vol. 33, pp. 10–13, 1989, Frieser et al., "Die Grundlagen Der Photographischen Prozesse Mit Silverhalogeniden", Akademische Verlaggesellschaft, Frankfurt, 1968, "Nikkakyo Geppo", December 1984, pp. 18–27, "Nihon Shashin Gakkaishi", vol. 49, pp. 7–12, 1986, vol. 52, pp. 144–166, 1989, vol. 52, pp. 41–48, 1989, JP-A-58-113926, JP-A-58-113927, JP-A-58-113928, JP-A-59-90841, JP-A-58-111936, JP-A-62-99751, JP-A-60-143331, JP-A-60-143332, JP-A-61-14630, JP-A-62-6251, JP-A-63-220238, JP-A-63-151618, JPA-63-281149, JP-A-59-133542, JP-A-59-45438, JP-A-62-269958, JP-A-63-305343, JP-A-59-142539, JP-A-62-253159, JP-A-62-266538, JP-A-63-107813, JP-A-64-26839, JP-A-62-157024, JP-A-62-192036, JP-A-1-297649, JP-A-2-127635, JP-A-1-158429, JP-A-2-42, JP-A-2-24643, JP-A-1-146033, JP-A-2-838, JP-A-2-28638, JP-A-3-109539, JP-A-3-175440, JP-A-3-121443, JP-A-2-73245, and JP-A-3-119347, U.S. Pat. Nos. 4,636,461, 4,942,120, 4,269,927, 4,900,652, and 4,975,354, European Patent 0355568A2, JP-A-4-193336, JPA-4-229852, JP-A-3-200952, JP-A-3-246534, JP-A-4-34544 and JP-A-4-226449 and Japanese Patent Application Nos. 3-160395 and 4-77261.

The present invention is further described in the following Examples, but the present invention should not be construed as being limited thereto.

EXAMPLE 1

A gelatin solution-1 [$H_2O$: 1,200 cc; non-deionized alkali-treated gelatin obtained from a fresh bone (hereinafter referred to as "new bone Ge 1"): 24 g; $KNO_3$ (1N): 5 cc; pH adjusted with KOH (1N) to 9.0] were placed in a reaction vessel maintained at a temperature of 50° C. 1.0 cc of $AgNO_3$–1 solution (1 g of $AgNO_3$/10 cc) was then added to the material with stirring. After 5 minutes, Ag–1 aqueous solution (2 g of $AgNO_3$/10 cc) and X–1 aqueous solution (1.4 g of KBr/10 cc) were then added to the material at a rate of 48 cc/min. for 1 minute by a double jet process with a precision liquid pump. The material was then stirred for 1 minute. The material was then adjusted to pH 6.5 with $HNO_3$ solution and KOH solution. The silver potential of the solution was then adjusted to 150 mV (relative to a room temperature saturated calomel electrode) with $AgNO_3$–2 solution (3 g of $AgNO_3$/100 cc) and KBr–1 solution (3 g of KBr/100 cc). The solution was then heated to a temperature of 75° C. over a period of 10 minutes, and then ripened at 75° C. for 30 minutes.

A replica of emulsion grains sampled at this time was then photographed under a transmission electron microscope (hereinafter referred to as "TEM") for observation. As a result, the proportion of projected area of grains having (100) planes as main planes and a rectangular parallelogram shape with an aspect ratio of 1.3 or more (hereinafter referred to as "tabular grains A") was about 90%. These grains had an average diameter of 0.6 $\mu$m calculated in terms of projected area, an average aspect ratio of 4.3, and a grain size distribution coefficient of variation of about 32%.

Subsequently, 0.1 mol of an emulsion of finely divided AgBr grains (average grain diameter: 0.038 $\mu$m) was added to the emulsion to adjust its pBr and pH values to 3.0 and 4.5, respectively. The emulsion was then ripened for 18 minutes. Furthermore, 0.1 mol of the finely divided grains was added to the system which was then ripened at a pBr value of 2.8 for 18 minutes. This procedure was repeated twice. The emulsion was then adjusted to pH 2.0. The emulsion was then ripened at a temperature of 60° C. for 10 minutes. A precipitant was then added to the emulsion. The emulsion was cooled down to a temperature of 30° C. where it was then rinsed by a well known sedimentation process. An aqueous solution of gelatin was then added to the emulsion. The emulsion was then redispersed. The emulsion was adjusted to pH 6.4 and pBr 2.8. The emulsion grains thus obtained were then photographed under TEM for observation. As a result, the proportion of tabular grains 1 was 60% calculated in terms of projected area. The average grain diameter of these tabular grains was 1.21 $\mu$m calculated in terms of projected area. The average aspect ratio of these grains was 5.4. The proportion of tabular grains 2 was 30% calculated in terms of projected area. The average grain diameter of these tabular grains 2 was 1.1 $\mu$m calculated in terms of projected area. The average aspect ratio of these tabular grains 2 was 4.8. The coefficient of variation of grain size distribution of these tabular grains 2 was 33%.

EXAMPLE 2

The procedure of Example 1 was repeated until the tabular grains A having an average grain diameter of 0.6 $\mu$m calculated in terms of projected area were obtained. 0.1 mol of an emulsion of finely divided AgBrI grains ($I^-$ content: 1.5 mol %; average grain diameter: 0.033 μm) was then added to the system. The emulsion was then ripened at pBr 3.2 and pH 6.5 for 25 minutes. 0.1 mol of an emulsion of finely divided AgBr grains (average grain diameter: 0.038 μm) was then added to the system. The emulsion was then ripened at pBr 2.8 and pH 6.5 for 18 minutes. Further, 0.1 mol of the AgBr fine-grain emulsion described in the following section was additionally added to the system. The emulsion was then ripened for 18 minutes. The emulsion was adjusted to pH 2.0 under which conditions it was ripened at a temperature of 60° C. for 10 minutes. A precipitant medium was then added to the emulsion. The emulsion was cooled to a temperature of 30° C. where it was then rinsed by a well known sedimentation process. An aqueous solution of gelatin was added to the emulsion. The emulsion was then redispersed. The emulsion was adjusted to pH 6.4 and pBr 2.8. The emulsion grains thus obtained were then photographed under TEM for observation. As a result, the proportion of tabular grains 1 was 63% calculated in terms of projected area. The average grain diameter of these tabular grains was 1.13 μm as calculated in terms of projected area. The average aspect ratio of these grains was 4.5. The proportion of tabular grains 2 was 28% calculated in terms of projected area. The average grain diameter of tabular grains 2 was 1.1 μm calculated in terms of projected area. The average aspect ratio of tabular grains 2 was 4.4. The coefficient of variation of grain size distribution of these tabular grains 1 and 2 was 35%. These tabular grains 1 and 2 had the structure shown in FIG. 2C.

EXAMPLE 3

A gelatin solution-1 [$H_2O$: 1,200 cc; new bone Ge 1: 8 g; empty gelatin in which impurity cations and impurity anions have been deionized: 16 g; $KNO_3$ (1N): 5 cc; pH adjusted with KOH (1N) to 9.0] was placed into a reaction vessel which maintained at a temperature of 40° C. 5 cc of $AgNO_3$–1 solution was then added to the material with stirring. After 5 minutes, Ag–1 aqueous solution and X–1 aqueous solution were then added to the material at a rate of 48 cc/min. for 1 minute by a double jet process with a precision liquid pump. The material was then stirred for 1 minute. The material was then adjusted to pH 6.5. The silver potential of the solution was then adjusted to 150 mV with $AgNO_3$–2 solution and KBr–1 solution. The solution was then heated to a temperature of 75° C. over a period of 10 minutes, and was ripened at 75° C. for 18 minutes. Subsequently, 0.1 mol of the AgBr fine-grain emulsion described in the following section was added to the emulsion to adjust its pBr and pH values to 3.1 and 6.5, respectively. The emulsion was then ripened for 18 minutes. Further, 0.1 mol of the fine-grain emulsion described in the following section was additionally added to the system which was then ripened for 18 minutes. This procedure was repeated twice. The emulsion was then adjusted to pH 2.0. The emulsion was then ripened at a temperature of 60° C. for 10 minutes. A precipitant was then added to the emulsion. The emulsion was cooled to a temperature of 30° C. where it was then rinsed by a well known sedimentation process. An aqueous solution of gelatin was then added to the emulsion. The emulsion was then redispersed. The emulsion was adjusted to pH 6.4 and pBr 2.8. The emulsion grains thus obtained were then photographed under TEM for observation. As a result, the proportion of tabular grains 1 was 50% calculated in terms of projected area. The average grain diameter of these tabular grains was 1.3 μm calculated in terms of projected area. The average aspect ratio of these grains was 6.0. The proportion of tabular grains 2 was 40% calculated in terms of projected area. The average grain diameter of these tabular grains 2 was 1.2 μm as calculated in terms of projected area. The coefficient of variation of grain size distribution of these tabular grains 2 was 34%.

(Preparation of fine-grain emulsion)

The aforementioned AgBr and AgBrI fine-grain emulsions were prepared as follows. An aqueous solution of gelatin (water: 1,200 cc; empty gelatin with an average molecular weight of 30,000: 25 g; KBr: 0.2 g; pH 8.0) was placed into a reaction vessel maintained at a temperature of 20° C. To the material were then added an $AgNO_3$ solution (0.3 g of $AgNO_3$/cc) and an $X^-$ salt solution (0.177 mol/100 cc) at a rate of 90 cc/min. for 3 minutes with stirring to obtain the desired emulsion.

COMPARATIVE EXAMPLE 1

The procedure of Example 1 was repeated until the tabular grains A were obtained. 0.1 mol of the AgBr fine-grain emulsion was then added to the system. The emulsion was then ripened at pBr 4.8 and pH 6.5 for 18 minutes. 0.1 mol of the fine-grain emulsion was then additionally added to the system. The emulsion was then ripened at pBr 4.8 for 18 minutes. This procedure was repeated twice. The emulsion was then ripened at pH 2.0 at a temperature of 60° C. for 10 minutes. A precipitant medium was then added to the emulsion. The emulsion was cooled to a temperature of 30° C. at which temperature the emulsion was rinsed by a well known sedimentation process. An aqueous solution of gelatin was added to the emulsion. The emulsion was then redispersed. The redispersed emulsion was adjusted to pH 6.4 and pBr 2.8. The emulsion grains thus obtained were then photographed under TEM for observation. As a result, the proportion of tabular grains 1 was 0% calculated in terms of projected area (i.e., no tabular grains 1 were observed). The proportion of tabular grains 2 was about 90% calculated in terms of projected area. The average grain diameter of these tabular grains 2 was 1.12 μm calculated in terms of projected area. The average aspect ratio of these tabular grains 2 was 5.1. The coefficient of variation of grain size distribution of these tabular grains 2 was 32%.

To each of the emulsions obtained in Examples 1 to 3 and Comparative Example 1 was added Dye 1 in an amount of 70% of saturated adsorption. These emulsions were then heated to a temperature of 55° C.

Dye 1

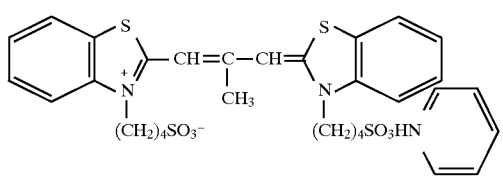

To each emulsion hypo was then added in an amount of $2\times10^{-5}$ mol/mol.AgX. After 5 minutes, a gold sensitizer (chloroauric acid : NaSCN=1:50) was added to the emulsion in an amount of $1\times10^{-5}$ mol/mol.AgX. After 30 minutes, the emulsion was cooled to a temperature of 40° C. A fog inhibitor TAI (4-hydroxy-6-methyl-1,3,3a,7-tetraazaindene) was added to the emulsion in an amount of $2\times10^{-3}$ mol/mol.AgX. A thickening agent (sodium poly-p-styrenesulfonate) and a coating aid (sodium dodecylbenzenesulfonate) were added to the emulsion. The emulsion was then coated on an undercoated TAC (cellulose triacetate) base with a protective layer in an amount of 1 g/m$^2$ calculated in terms of silver. The coated specimen was then wedgewise exposed to light through a minus blue filter for $10^{-2}$ seconds, and then developed with MAA-1 developer ("Journal of Photographic Science", vol. 23, pp. 249–256, 1975) at a temperature of 20° C. for 10 minutes. The specimen was passed through a stop bath, a fixing bath and a washing bath, and then dried. The results of the photographic properties of the specimens were as follows. Example 1 exhibited a relative sensitivity of 116 and graininess of 95, while Comparative Example 1 exhibited a relative sensitivity of 100 and graininess of 100. These results demonstrate that the emulsion according to the present invention has excellent sensitivity and graininess as compared with the conventional emulsion of Comparative Example 1. Example 2 exhibited a relative sensitivity of 118 and graininess of 97. Example 3 exhibited a relative sensitivity of 113 and a graininess of 97. These results demonstrate that these emulsions of the invention have excellent sensitivity and graininess as compared with Comparative Example 1. RMS granularity was determined with a specimen which had been uniformly exposed to light with an exposure providing a density of (fog+0.2), and then developed in the aforementioned manner, in accordance with the method described in James, "The Theory of the Photographic Process", Chapter 21, 1977. This value was determined relative to that of the comparative specimen as 100.

EXAMPLE 4

A gelatin solution-2 [$H_2O$: 1,200 cc; empty gelatin: 24 g; $KNO_3$ (1N): 5 cc; pH adjusted with KOH (1N) to 8.0] was placed into a reaction vessel maintained at a temperature of 40° C. 10 cc of $AgNO_3$–1 solution was then added to the material with stirring. After 5 minutes, Ag–1 aqueous solution and X–1 aqueous solution were then added to the material at a rate of 48 cc/min. for 15 seconds by a double jet process with a precision plunger pump. The material was then stirred for 2 minutes. Ag–2 aqueous solution (2.83 g of $AgNO_3$/100 cc) and X–2 aqueous solution (1 g of NaCl/100 cc) were then added to the material at a rate of 62 cc/min. for 25 seconds by a double jet process. The emulsion was then stirred for 3 minutes. Ag–1 aqueous solution and X–1 aqueous solution were then added to the material at a rate of 48 cc/min. for 45 seconds. The material was then adjusted to pH 6.0 and a silver potential of 150 mV with 1N $HNO_3$ solution. The emulsion was then heated to a temperature of 75° C. in ten minutes at which temperature the emulsion was ripened for 5 minutes. With the silver potential maintained at 150 mV, 0.4 mol of the aforementioned fine-grain emulsion was added to the system which was then ripened for 25 minutes. The silver potential of the emulsion was then adjusted to 120 mV. 0.3 mol of the aforementioned AgBrI fine-grain emulsion was added to the system which was then ripened for 27 minutes. The emulsion was adjusted to pH 2.0 at which the emulsion was then ripened at a temperature of 60° C. for 10 minutes. A precipitant medium was then added to the emulsion. The emulsion was cooled to a temperature of 30° C. at which temperature the emulsion was rinsed by a well known sedimentation process. An aqueous solution of gelatin was then added to the emulsion. The emulsion was then redispersed. The emulsion was adjusted to pH 6.4 and pBr 2.8. The emulsion grains thus obtained were then photographed under TEM for observation. As a result, the proportion of tabular grains 1 was 58% calculated in terms of projected area. The average grain diameter of these tabular grains was 1.4 $\mu$m calculated in terms of projected area. The average aspect ratio of these grains was 11.2. The proportion of tabular grains 2 was 33% calculated in terms of projected area. The average grain diameter of these tabular grains 2 was 1.3 $\mu$m calculated in terms of projected area. The average aspect ratio of these tabular grains 2 was 10.3. The coefficient of variation of grain size distribution of these tabular grains 1 and 2 was 28%. 95% or more of these tabular grains 1 and 2 had an adjacent side ratio of 2 or less. The grains thus formed are of the type shown in FIG. 2B. These tabular grains 1 and 2 had a halogen composition gap with a $Cl^-$ content difference of 100% in their central portion. These tabular grains 1 had an average percentage y of 10%. The emulsion was then treated in the same manner as in Examples 1 to 3, and then coated on a base to prepare a coated specimen which was subsequently exposed to light and developed. The specimen exhibited a relative sensitivity of 120 and graininess of 90. It was thus confirmed that the specimen had excellent sensitivity and graininess.

The present invention provides AgX emulsions having improved sensitivity and image quality, as compared with conventional AgX emulsions containing tabular grains having 100 planes.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising a dispersing agent and a mixture of chemically sensitized first and second tabular silver halide grains, wherein:

the average silver halide composition of the mixture of first and second tabular grains is AgClBr (AgCl content: 75 mol % or less), AgBrI (AgI content: 30 mol % or less), or AgBrClI (AgCl content: 75 mol % or less, AgI content: 30 mol % or less), the emulsion is produced via at least a nucleation step followed by a ripening step, and the first tabular grains account for at least 30% but less than 100% of the total projected area of all silver halide grains and are characterized in that:

(a) the first tabular grains have a (100) plane as a main plane and an aspect ratio (diameter/thickness) of 2.0 to 20, and a shape on the main plane of a rectangular parallelogram having one to four corners non-equivalently missing;

(b) each of the one to four missing corners has a missing portion bounded by extending the sides of the parallelogram at each missing corner, and the ratio x, (the area of the maximum missing portion among said missing portions)/(the area of the minimum missing portion (which include zero)), is 2 or more;

(c) the length of a side of the maximum missing portion is from 15% to 50% of the length of the respective side of a true rectangular parallelogram formed by extending the sides of the rectangular parallelogram having at least one missing corner; and (d) the first tabular grains have intragrain defects that give a growth vector in a direction toward an edge, wherein the intragrain defects are formed during a defect formation step by forming one or more gap interfaces formed by precipitating silver halide phases having a difference in AgCl content, AgBr content or AgI content in the range of 10 to 100 mol % on defect-free nuclei.

2. The silver halide emulsion of claim 1, wherein 20% or more of the total projected area of grains other than said first tabular grains is occupied by second tabular grains having a (100) plane as a main plane, an aspect ratio of 1.5 or more and a rectangular parallelogram shape on the main plane.

3. The silver halide emulsion of claim 1, wherein x is 4 or more.

4. The silver halide emulsion of claim 1, wherein x is 6 or more.

5. The silver halide emulsion of claim 1, wherein the edge face of the missing one to four corners constitutes a (111) plane of said first tabular silver halide grains.

6. The silver halide emulsion of claim 1, wherein said first tabular grains have an aspect ratio of from 4 to 20.

7. The silver halide emulsion of claim 1, wherein said first tabular grains account for at least 60% but less than 100% of the total projected area of all silver halide grains contained in the emulsion.

8. The silver halide emulsion of claim 1, wherein said first tabular grains have an average diameter of from 0.15 to 5 $\mu$m.

9. The silver halide emulsion of claim 1, wherein the length of a side of the minimum missing portion in said first tabular grains is no more than 20% of the length of the respective side of a true rectangular parallelogram formed by extending the sides of the rectangular parallelogram having at least one missing corner.

10. The silver halide emulsion of claim 1, wherein the first tabular grains are characterized in that the length of a side of the maximum missing portion is proportionately the same as or greater than the length of the corresponding side of the maximum missing portion of the tabular grain (a1) in FIG. 1A.

11. The silver halide emulsion of claim 1, wherein the first tabular grains are characterized in that the length of a side of the maximum missing portion is proportionately the same as or greater than the length of the corresponding side of the maximum missing portion of the tabular grain (a2) in FIG. 1C.

12. The silver halide emulsion of claim 1, wherein the halogen composition gap interface is a difference in $Cl^-$ content between $AgBr_{1-x}Cl_x$ phases of from 10 to 100 mol % or a difference in $I^-$ content between $AgBr^{1-x}I_x$ phases of from 10 to 100 mol %, where $0 \leqq x \leqq 1$.

13. The silver halide emulsion of claim 1, wherein the first tabular grains are characterized in that the length of a side of the maximum missing portion is proportionately the same as or greater than the length of the corresponding side of the maximum missing portion of the tabular grain (a3) in FIG. 1B.

14. The silver halide emulsion of claim 1, wherein said ripening step is conducted at a temperature at least 10° C. higher than the nucleation step temperature.

15. The silver halide emulsion of claim 1, wherein the difference in AgCl content or AgI content across at least one gap interface is in the range of 50 to 100 mole %.

16. The silver halide emulsion of claim 1, wherein the difference in AgCl content across at least one cap interface is in the range of 80 to 100 mole %.

17. The silver halide emulsion of claim 1, wherein the intragrain defects are formed by forming one or more gap interfaces formed by precipitating silver halide phases having a difference in AgBr content in the range of 10 to 100 mol %.

* * * * *